US009079593B1

(12) United States Patent
Burns

(10) Patent No.: US 9,079,593 B1
(45) Date of Patent: Jul. 14, 2015

(54) METHOD OF IMPROVING SHUNT DETECTION ON RAILROAD TRACKS AND RAILROAD HIGHWAY CROSSING SIGNAL ELECTRONIC ASSEMBLY

(71) Applicant: Railroad Signal International, L.L.C., Tulsa, OK (US)

(72) Inventor: Eddie Burns, Tulsa, OK (US)

(73) Assignee: Railroad Signal International, L.L.C., Tulsa, OK (US)

( * ) Notice: Subject to any disclaimer, the term of this patent is extended or adjusted under 35 U.S.C. 154(b) by 0 days.

(21) Appl. No.: 14/151,174

(22) Filed: Jan. 9, 2014

(51) Int. Cl.
*B61L 29/00* (2006.01)
*B61L 29/28* (2006.01)

(52) U.S. Cl.
CPC ..... *B61L 29/286* (2013.01)

(58) Field of Classification Search
CPC ..... B61L 29/00; B61L 29/04; B61L 29/24; B61L 29/32; B61L 29/30; B61L 29/22; B61L 13/00; B61L 1/18; B61L 1/181; B61L 23/34; B61L 23/044
See application file for complete search history.

(56) References Cited

U.S. PATENT DOCUMENTS

| | | | | |
|---|---|---|---|---|
| 3,879,004 | A * | 4/1975 | Andreasen | 246/62 |
| 3,892,377 | A * | 7/1975 | Hathaway | 246/62 |
| 4,467,430 | A * | 8/1984 | Even et al. | 701/117 |
| 4,666,108 | A * | 5/1987 | Fox | 246/125 |
| 4,895,325 | A * | 1/1990 | LeVoir | 246/473.1 |
| 2006/0060724 | A1 * | 3/2006 | Francis et al. | 246/122 R |
| 2012/0286103 | A1 * | 11/2012 | Hilleary | 246/125 |
| 2014/0346284 | A1 * | 11/2014 | Fries et al. | 246/125 |
| 2014/0361125 | A1 * | 12/2014 | Fries et al. | 246/473.1 |
| 2014/0361126 | A1 * | 12/2014 | Steffen et al. | 246/473.1 |
| 2014/0367526 | A1 * | 12/2014 | Steffen et al. | 246/126 |

OTHER PUBLICATIONS

Brian Solomon, Railroad Signaling, 2003, pp. 145-155, published by MBI Publishing Company, St. Paul, Minnesota, USA.

* cited by examiner

*Primary Examiner* — Jason C Smith
(74) *Attorney, Agent, or Firm* — Head, Johnson & Kachigian, P.C.

(57) ABSTRACT

A railroad highway crossing signal electronic assembly for use on bi-directional tracks, where a control unit sends AC voltage to an approaching rail segment wherein a rectifier receives AV voltage and discharges DC voltage which is sent back to a relay which controls lights on a gate arm. There is also a separate high current DC output to tracks. When shorted, the high current DC output creates sparks to improve detection of a train.

14 Claims, 6 Drawing Sheets

METHOD OF IMPROVING SHUNT DETECTION ON RAILROAD TRACKS AND RAILROAD HIGHWAY CROSSING SIGNAL ELECTRONIC ASSEMBLY

CROSS REFERENCE

Not Applicable.

BACKGROUND OF THE INVENTION

1. Field of the Invention

The present invention relates to a method of improving shunt detection on railroad tracks and to a railroad highway crossing signal electronic assembly, and more particularly, but not by way of limitation, to a railroad highway crossing signal electronic assembly that improves train detection on rails with poor shunting conditions.

2. Description of the Related Art

Grade-crossing signals and gate arms can be actuated by a variety of track circuits. A traditional relay circuit has often been used for grade-crossing signals and gate arms.

When the circuit detects the presence of a train, it actuates circuits that cause grade-crossing signals to begin flashing and cause gates to be lowered if train exists in the crossing.

Grade crossing predictor circuits are able to determine a distance from the train to the crossing and can determine whether the train is approaching the crossing or moving away from the crossing. This ability allows a controller to activate a warning system with a warning time prior to the train reaching the crossing.

Some prior circuits employ tuned shunts at either end of an approach area to a crossing and work by transmitting a signal through the rails and shunts and sensing an inductance (or impedance) of the circuit formed by the track rails and shunts.

When a train approaches a crossing, the train's axles and wheels create a short circuit between the pair of rails, which towers the total apparent inductance.

By monitoring the inductance or impedance changes, the location of the train can be determined so that a warning system can be activated.

Unfortunately, grade crossing circuits do not work in all circumstances. For example, grade crossing circuits may not work, or may not work reliably, with poor shunting conditions.

Poor shunting conditions may be caused by low traffic on the rails, which may in turn cause rusts on the rails.

Poor shunting conditions may also be caused by light weight cars on the rails.

Poor shunting conditions may also be caused by vegetation, such as weeds, growing around the tracks, which prevents an electrical connection between the wheels and the tracks.

Based on the foregoing, it is desirable to provide a railroad highway crossing signal electronic assembly with high current sparks to jump gaps between the wheels and the track rails to overcome poor shunting conditions.

It is further desirable to provide an improved railroad highway crossing signal electronic assembly that can manage a C-style circuit.

It is further desirable to make a more cost effective railroad highway crossing signal electronic assembly that uses a single integrated unit to manage train detection and to activate warning lights and gates.

SUMMARY OF THE INVENTION

The present invention relates to a method to improve shunt detection on railroad tracks. A high direct current driver provides sparks to a railroad track segment to improve shunting conditions. The invention also relates to an integrated railroad highway crossing signal electronic assembly which improves shunt detection and detects the presence of trains. The assembly includes a housing, a power inverter, a blackout detector, an isolated step down transformer, and a high current driver.

The power inverter may receive voltage from an external power supply, which makes the inverter oscillate to produce an output of power. The power inverter may be connected electronically to the blackout detector. The blackout detector may detect VAC presence and switch to DC power supply when the VAC is absent. The blackout detector may revert back to AC power when it is available. The blackout detector may be connected electronically to the power inverter. The blackout detector may also be connected electronically to the isolated step down transformer.

The isolated step down transformer may take VAC or the output of the power inverter and produce outputs of VAC with multiple ampere capacities each. The isolated step down transformer may be connected electronically to the blackout detector. The isolated step down transformer may be connected electronically to the high current driver. The isolated step down transformer may be connected electronically to AC outlets.

The high current driver may turn the AC output from the isolated step down transformer to a high current output capable of driving multiple amperes of DC current. The high current driver may be connected electronically to the isolated step down transformer. The high current driver may be connected electronically to a high DC current output.

Additionally, the railroad highway crossing signal electronic assembly may be used to manage a C-style circuit.

DETAILED DESCRIPTION OF THE INVENTION

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

The present invention relates to a method of improving shunt detection on bi-directional railroad tracks, and to an integrated railroad highway crossing signal electronic assembly. More particularly, but not by way of limitation, the present invention provides a method of improving shunt detection using high current DC output to railroad track rails.

Figure 1:
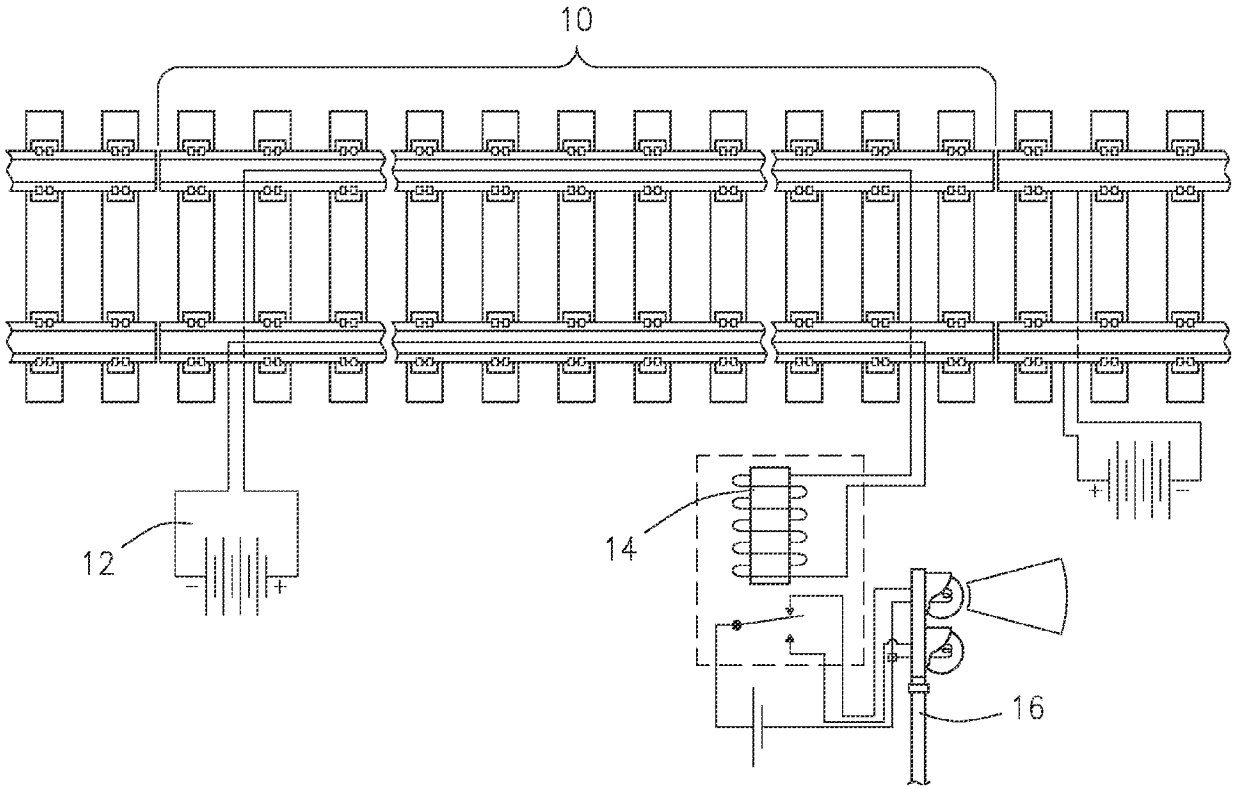
FIG. 1 PRIOR ART
FIG. 1 is a diagrammatic view of a crossing signal circuit with unoccupied train track segments as shown in the prior art.

FIG. 1 depicts a prior art crossing signal circuit with unoccupied train track segments 10. A battery or other power source 12 is electrically connected to a relay 14 through a pair of rails. The relay is, in turn, electrically connected to a gate arm mechanism 16, which alerts drivers and/or pedestrians when a train is near once it is activated.

Figure 2:
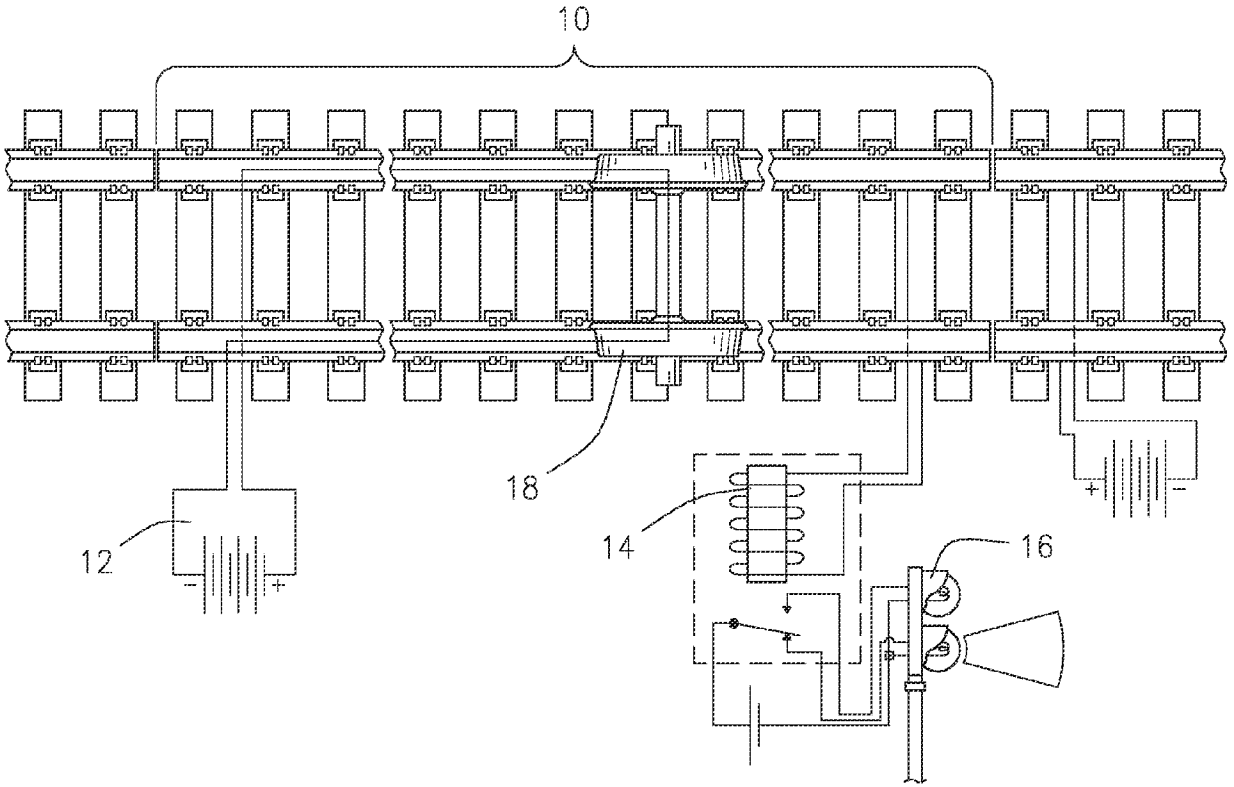
FIG. 2 PRIOR ART
FIG. 2 is a diagrammatic view of a crossing signal circuit with occupied train track segments as shown in the prior art.

FIG. 2 depicts a prior art crossing signal circuit with an occupied train track segment 10. A battery or other power source 12 generates a current to a segment of train tracks. When the current is shorted by train wheels and axles 18 breaking the connection, a signal relay 14 is de-energized. When the signal relay 14 is de-energized, a signal is sent to the gate arm mechanism 16 and warning lights which begins to alert drivers or pedestrians that the train is coming on the tracks.

Figure 3:
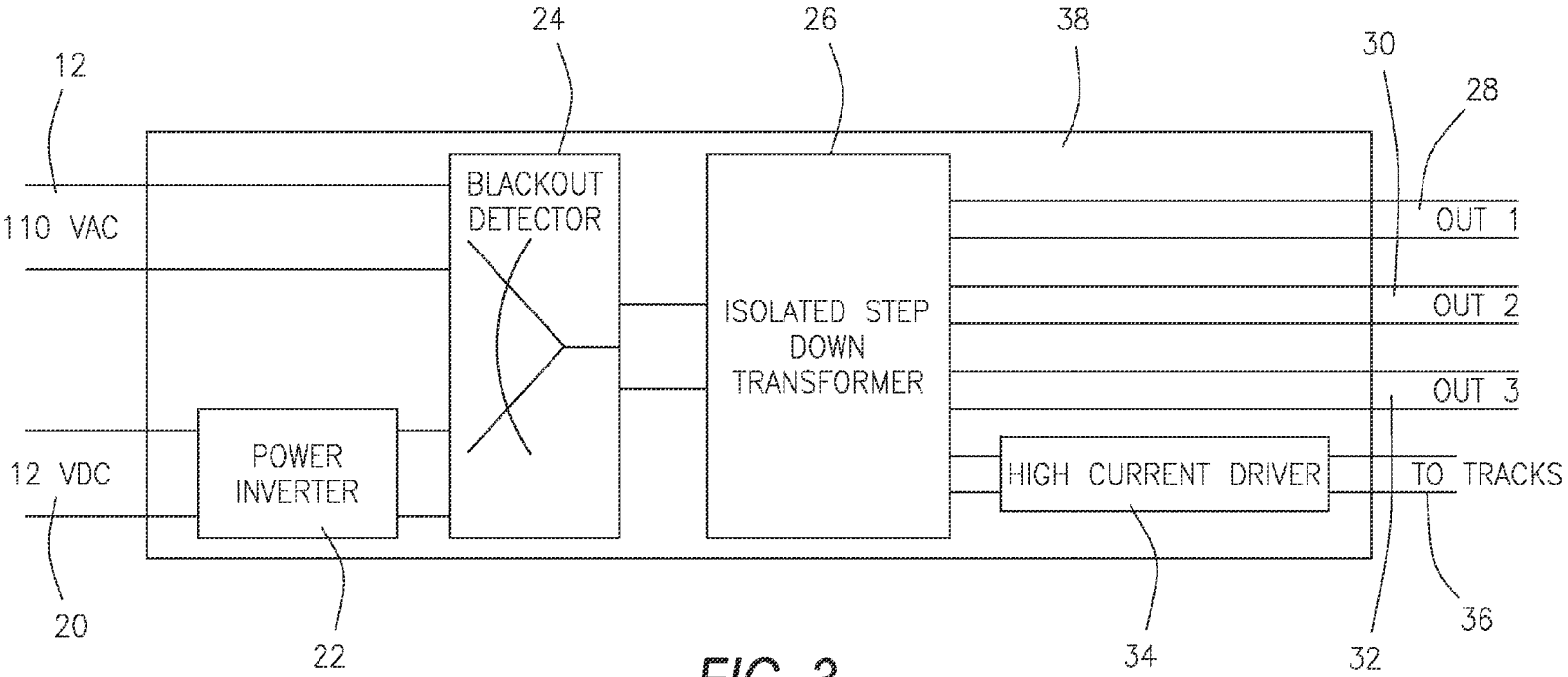
FIG. 3 is a schematic block diagram of a railroad highway crossing signal electronic assembly in accordance with the present invention.

FIG. 3 depicts a block diagram of an integrated railroad highway crossing signal electronic assembly 38 in accordance with the present invention. Under normal conditions, power is supplied by an alternating current (AC) power source 12, such as a 110 VAC. A power inverter 22 is electronically connected and receives voltage from an external DC power supply 20 of between 12 VDC and 13.5 VDC. This power supply 20 makes the power inverter 22 oscillate to produce a peak output of 170 VAC.

A blackout detector 24 detects presence of the alternating current (VAC) 12 and switches to the DC power supply 20 when the VAC is absent. When the AC power 12 is available, the blackout detector will revert to using the AC power. The blackout detector 24 is connected electrically to both the power supply 12 and to the power inverter 22.

An isolated step down transformer 26 receives 110 VAC or the output of the power inverter 22 and produces four separate outputs of 6.3 VAC nominal with 3 amperes of capacities each. The isolated step down transformer 26 sends an output to a first AC output 28. The isolated step down transformer also sends an output to a second AC output 30. Finally, the isolated step down transformer sends an output to a third AC output 32.

A separate high current driver 34 turns the AC output from the isolated step down transformer 26 into a high current DC output 36 capable of driving up to 3 amperes of direct current (DC).

Figure 4:
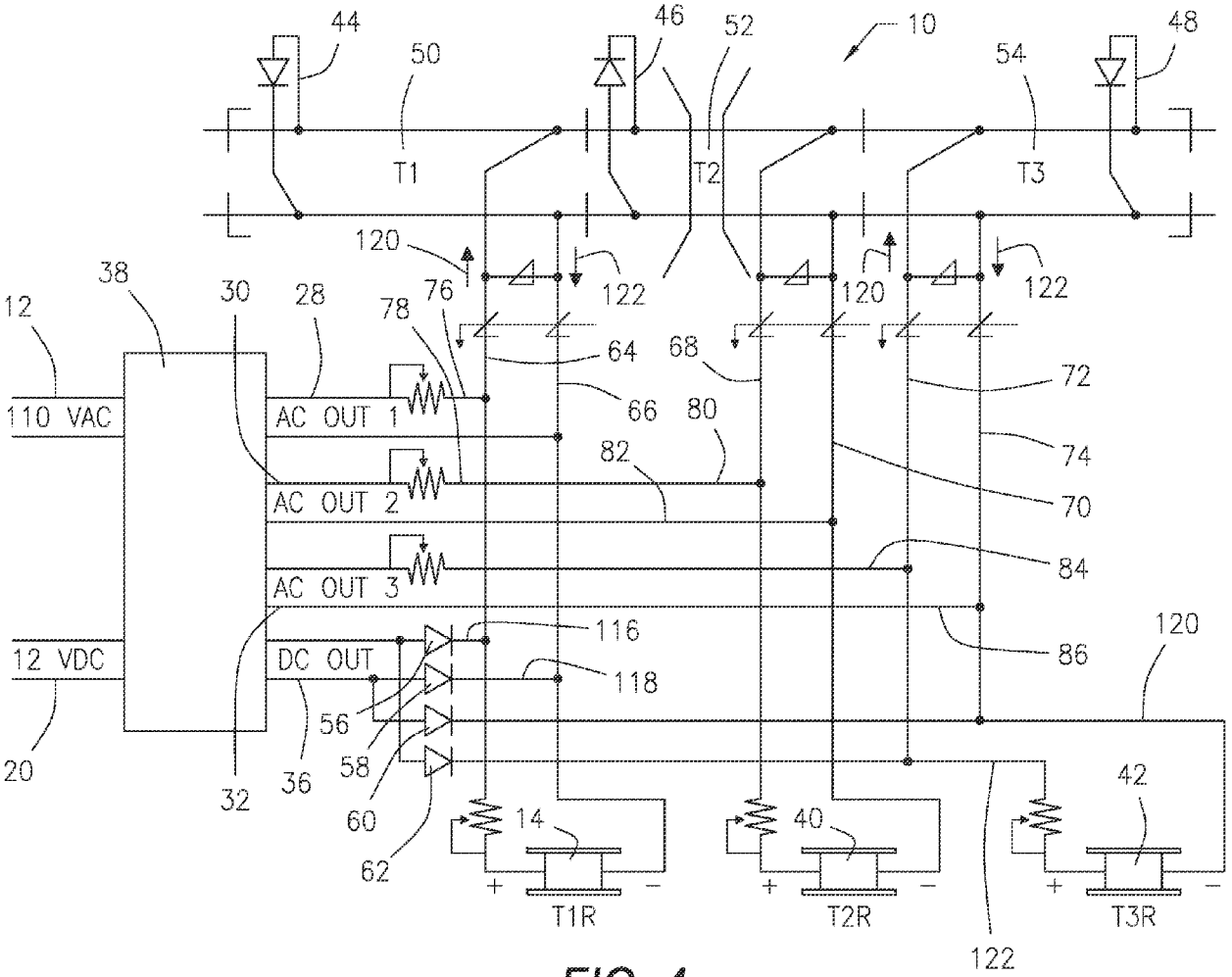
FIG. 4 is a schematic diagram of the railroad highway crossing signal electronic assembly shown in FIG. 3 connected to a C-style circuit in accordance with the present invention.

FIG. 4 depicts a simplified circuit diagram of the integrated railroad highway crossing signal electronic assembly 38 connected to a C-style circuit. Three isolated rail track segments 50, 52, and 54 are provided, which are isolated from each other by a gap and insulating material. Three rectifiers 44, 46, and 48, respectively, are provided, each of which span the rails of the track segments 50, 52 and 54, respectively. A relay 14, 40, and 42 for each rail track segment 50, 52 and 54, respectively.

A first AC output 28 is connected to the rails of the first rail track segment 50. A second AC output 30 is connected to the rails of the second rail track segment 52. A third AC output 32 is connected to the rails of the third rail track segment 54. Alternating current is delivered to each track segment as shown by arrow 120. High current DC output 36 is connected to the first track and third track segments. Diodes 56, 58, 60, and 62 may be connected to high current output 34 to prevent high current DC output 34 shunted in one track to be shorted at the other track.

A C-style circuit may be utilized with the bi-directional railroad tracks 10 having the three isolated rail track segments 50, 52, and 54. Train wheels and axles 18 may shunt the current between one of the track segments. When this occurs, the correspondent rectifier 44, 46, or 48 will be shorted, taking off the direct current in the corresponding segment 50, 52 or 54, de-energizing the corresponding relay 14, 40 or 42. When the direct current is sent to one of the relays, it de-energizes the relay. This de-energizing of the relay causes lights and/or a gate arm assembly 16 to function, which warns drivers or pedestrians that a train is on the tracks and is nearby.

Diodes 56, 58, 60, and 62 prevent the high current DC output 36 from being short circuited. For example, AC output is being delivered to the rails, illustrated by arrows 120, so rectifiers 44 and 48 receive AC voltage and deliver DC voltage, illustrated by arrows 122. When the train wheels enter segment 50 and short out the diode 44, the high current DC output 36 is also shorted out. DC voltage in that segment 50 disappears, dropping relay 14, but keeping the high DC output in segment 54 which is not shorted out.

The separate high current DC output 36 is sent to the track segments 50 and 54 all the time when the AC output has been shunted by the train. This high current DC output provides high current sparks and helps eliminate rust and improves detection of the train. The high current DC output 36 may be attached to the first 50 and third segments 54, but does not need to be attached to the island 52, or the middle segment.

Figure 5:
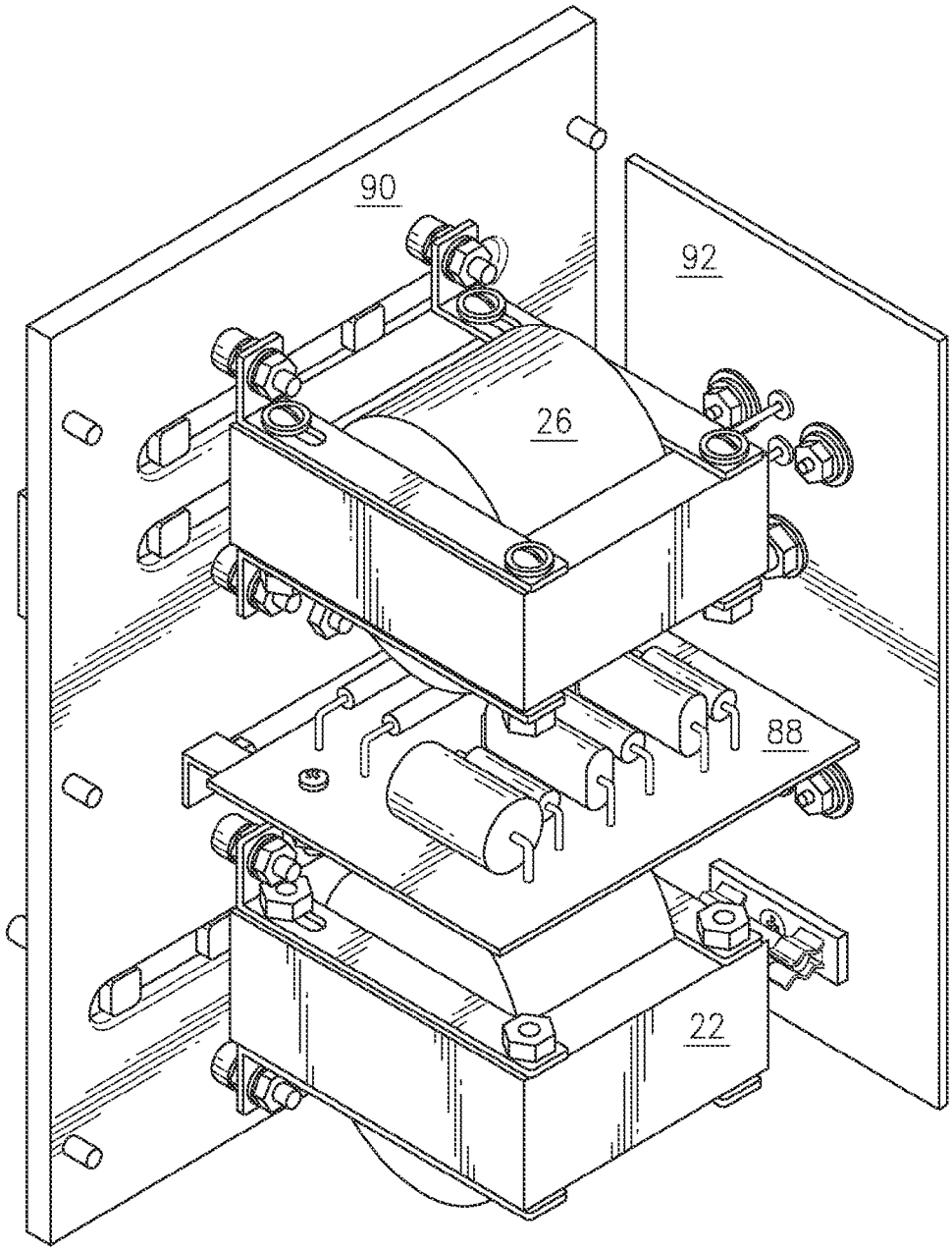
FIG. 5 is an internal perspective view of the railroad highway crossing signal electronic assembly in accordance with the present invention.

FIG. 5 depicts an internal view of the integrated railroad highway crossing signal electronic assembly 38. The isolated step down transformer 26 is shown attached to a front panel 90. The power inverter 22 is also attached to the front panel 90. A printed control board 88, used to mechanically support and electrically connect the electronic components of the claimed invention, is shown attached to the front panel 90. A heatsink mounting plate 92 acts as a heatsink which cools down the power component.

Figure 6:
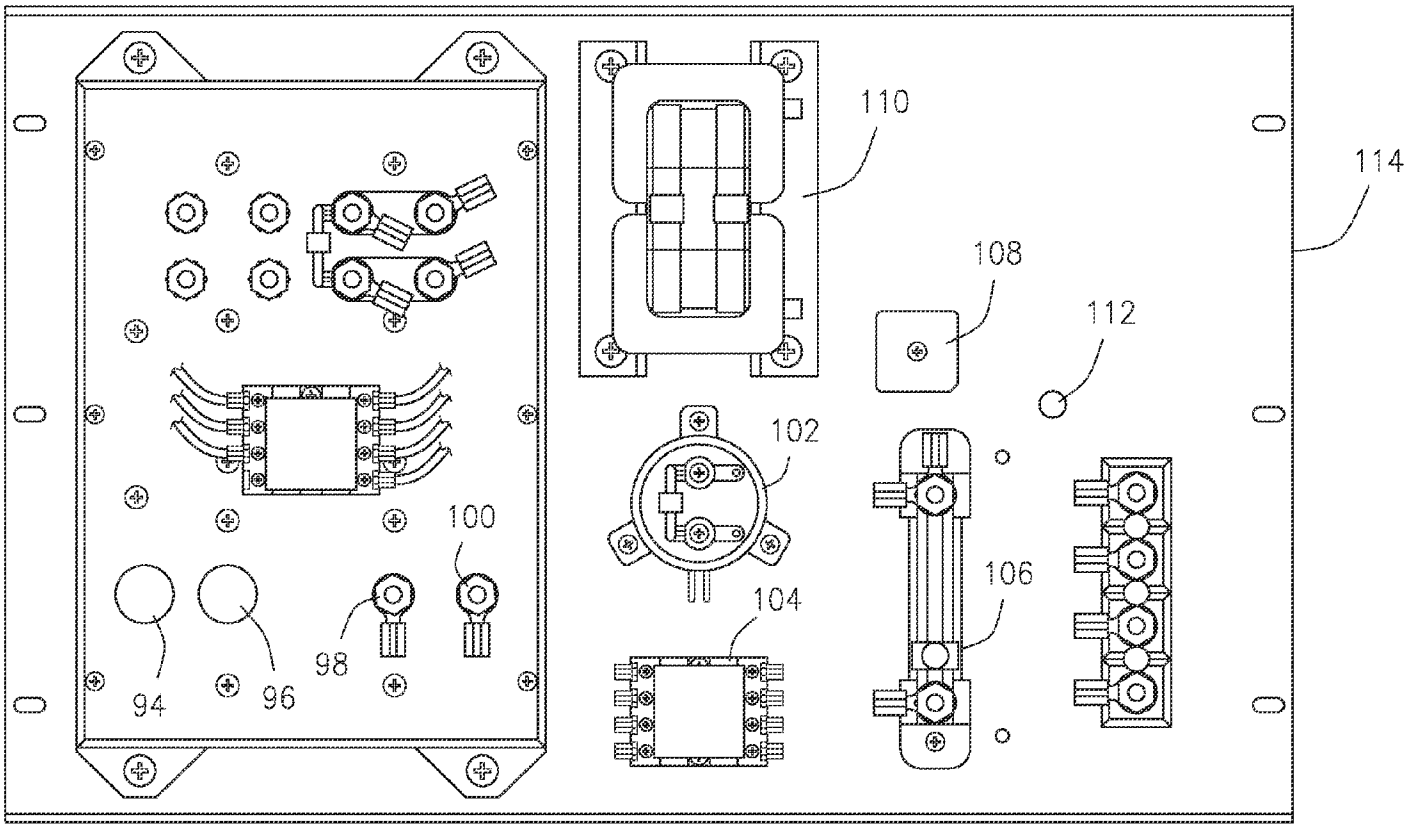
FIG. 6 is another perspective view of the railroad highway crossing signal electronic assembly in accordance with the present invention.

FIG. 6 depicts another perspective view of the railroad highway crossing signal electronic assembly 38. AC power inputs 94 and 96 are shown which will be connected to the AC power source 12. These are internally connected to the blackout detector (not shown), DC terminal inputs 98 and 100 are shown which will be connected to an external DC power source to provide a DC power supply 20. These are internally connected to the power inverter 22 (not shown). A capacitor 102, which will smooth the power output, may be a 40000 uf/25V capacitor. The capacitor 102 may also be used to block alternate current, while allowing direct current. A relay 104 is shown to operate a mechanical switch device. A resistor 106, to implement electrical resistance, may be an adjustable 1 ohm resistor. A bridge rectifier 108 may be used to perform a conversion of AC input to DC output. A choke 110 may be used to block higher-frequency alternating current in an electrical circuit, while allowing lower frequency or DC current to pass. A power indicator light 112 may be used to flash a light when the assembly is functioning. A mounting board 114 allows for mounting of different aspects of claimed invention.

The present invention provides an integrated railroad highway crossing signal electronic assembly which will improve shunt detection on railroad tracks while activating and controlling all warning lights and gate arm mechanisms.

Whereas, the present invention has been described in relation to the drawings attached hereto, it should be understood that other and further modifications, apart from those shown or suggested herein, may be made within the spirit and scope of this invention.

What is claimed is:

1. A method of improving shunt detection on railroad tracks having three electrically isolated rail track segments, a first rail segment, a third rail segment, and a second rail segment therebetween, the method comprising:

providing an apparatus having a housing, a power inverter, a blackout detector, an isolated step down transformer, and a high current DC driver;

connecting a first AC output to the first rail segment of the tracks, connecting a second AC output to the second rail segment of the tracks, connecting a third AC output to the third rail segment of the tracks, and connecting a high current DC output to the first and third segment of the tracks;

providing power to the apparatus via a power source;

sending alternating current from the first AC output to the first segment, sending alternating current from the second AC output to the second segment, and sending alternating current from the third AC output to the third segment;

sending direct current from the high current DC output to the first and third segments;

shunting said AC output when train wheels and axles make a connection between rails of each segment, causing a rectifier to change the AC output to DC voltage;

delivering the DC voltage from the rectifier to a relay, ending AC output until the last axle of the train leaves the rail track segment;

permitting high current DC to be sent to the track segment from the high current DC output, causing a high energy spark; and notifying a light and/or gate arm mechanism to alert drivers or pedestrians that the train is nearby.

2. The method of improving shunt detection on railroad tracks as set forth in claim 1 wherein said power inverter receives voltage from an external DC power supply and makes it oscillate, producing an output of VAC power.

3. The method of improving shunt detection on railroad tracks as set forth in claim 1 wherein said power inverter receives voltage from an external DC power supply of between 12 VDC and 13.5 VDC and makes it oscillate producing an output of 170 VAC peak.

4. The method of improving shunt detection on railroad tracks as set forth in claim 1 wherein said blackout detector detects VAC presence and switches to DC power supply when the VAC is absent.

5. The method of improving shunt detection on railroad tracks as set forth in claim 1 wherein said blackout detector reverts back to AC power when AC power is available.

6. The method of improving shunt detection on railroad tracks as set forth in claim 1 wherein said isolated step down transformer takes VAC or the output of the power inverter and produces multiple outputs of VAC with multiple ampere capacities each.

7. The method of improving shunt detection on railroad tracks as set forth in claim 1 wherein said isolated step down transformer takes 110 VAC or the output of the power inverter and produces four outputs of 6.3 VAC nominal with 3 ampere capacities each.

8. The method of improving shunt detection on railroad tracks as set forth in claim 1 wherein said high current driver convert the AC output as a high current DC output driving up to 5 amperes of DC current.

9. The method of improving shunt detection on railroad tracks as set forth in claim 1 wherein said circuit is a C-style circuit.

10. A railroad highway crossing signal electronic assembly, comprising:

a housing;

a power inverter, which receives voltage from an external DC power supply and makes the power inverter produce an output of VAC power;

a blackout detector, which detects VAC presence and switches to DC power supply when the VAC is absent and reverts back to VAC power when VAC power is available;

an isolated step down transformer, which takes VAC or the output of the power inverter and produces multiple outputs of VAC with multiple ampere capacities each; and a high current DC driver, which turns the VAC output to high current DC output driving up to multiple amperes of DC current.

11. The railroad highway crossing signal electronic assembly as set forth in claim 10 wherein said power inverter receives voltage from an external DC power supply of between 12 VDC and 13.5 VDC and makes it oscillate producing an output of 170 VAC peak.

12. The railroad highway crossing signal electronic assembly as set forth in claim 10 wherein said blackout detector detects 110 VAC presence and switches to DC power supply when the 110 VAC is absent.

13. The railroad highway crossing signal electronic assembly as set forth in claim 10 wherein said isolated step down transformer takes 110 VAC or the output of the power inverter and produces four outputs of 6.3 VAC nominal with 3 ampere capacities each.

14. The railroad highway crossing signal electronic assembly as set forth in claim 10 wherein said assembly manages a C-style circuit.

* * * * *